US008286835B2

(12) United States Patent
Morey et al.

(10) Patent No.: US 8,286,835 B2
(45) Date of Patent: Oct. 16, 2012

(54) PRODUCT DISPENSER CONNECTOR

(75) Inventors: John D. Morey, St. Paul, MN (US); Brian Philip Carlson, St. Paul, MN (US); Jay Richard Anderson, Kenyon, MN (US)

(73) Assignee: Ecolab USA Inc., St. Paul, MN (US)

( * ) Notice: Subject to any disclaimer, the term of this patent is extended or adjusted under 35 U.S.C. 154(b) by 1076 days.

(21) Appl. No.: 12/125,438

(22) Filed: May 22, 2008

(65) Prior Publication Data

US 2009/0289163 A1 Nov. 26, 2009

(51) Int. Cl.
*A47F 7/28* (2006.01)

(52) U.S. Cl. ... 222/180; 222/174; 248/215; 248/229.15; 248/311.2; 248/312

(58) Field of Classification Search ..... 222/153.01, 222/153.04, 153.09, 174, 180; 248/311.2, 248/312, 312.1, 313, 314, 316.1, 316.3, 316.7, 248/214, 215, 229.1, 229.15, 309.1
See application file for complete search history.

(56) References Cited

U.S. PATENT DOCUMENTS

| | | | | |
|---|---|---|---|---|
| 3,010,687 | A * | 11/1961 | Hagberg | 248/515 |
| 3,405,837 | A | 10/1968 | Carpenter, Jr. | |
| 3,734,439 | A * | 5/1973 | Wintz | 248/224.51 |
| 4,132,091 | A | 1/1979 | Aro et al. | |
| 4,615,476 | A | 10/1986 | Hobbs et al. | |
| 4,634,016 | A * | 1/1987 | Voss | 220/629 |
| 4,651,902 | A | 3/1987 | Hobbs et al. | |
| 5,423,509 | A | 6/1995 | LaPorte et al. | |
| 5,673,884 | A | 10/1997 | Yemini | |
| 6,357,616 | B1 | 3/2002 | Harris et al. | |
| 6,691,897 | B2 | 2/2004 | Ashe | |
| D533,742 | S | 12/2006 | Matthews et al. | |
| 2007/0095999 | A1 | 5/2007 | Dubois | |

FOREIGN PATENT DOCUMENTS

| | | |
|---|---|---|
| JP | 2002-153393 | 5/2002 |
| JP | 2007-202687 | 8/2007 |
| KR | 10-2008-0019090 | 3/2008 |
| WO | WO 98/00053 A1 | 1/1998 |
| WO | WO 99/40832 A1 | 8/1999 |

OTHER PUBLICATIONS

Search Report and Written Opinion for PCT/IB2009/052143 from the Korean Intellectual Property Office mailed Dec. 3, 2009.
Application Details for KR 20-1986-0009455 (Kwak, Sang Hee) Aug. 11, 1986 (three pages).
ENDURE® 320 Advanced Care Waterless Antimicrobial Hand Rinse, http://www.ecolab.com, 1 page, (© 2008 Ecolab).

* cited by examiner

*Primary Examiner* — J. Casimer Jacyna
(74) *Attorney, Agent, or Firm* — IPLM Group, P.A.

(57) ABSTRACT

A product dispenser assembly including a product dispenser, a mounting member, and a connector. The connector includes a first portion and a second portion. The first portion includes a receiving member configured and arranged to operatively connect the product dispenser thereto. The second portion includes a connecting member configured and arranged to operatively connect the mounting member thereto. The first and second portions are rotatably operatively connected to position the receiving member and the connecting member in different positions relative to one another.

32 Claims, 12 Drawing Sheets

PRODUCT DISPENSER CONNECTOR

FIELD OF THE INVENTION

The present invention relates to a product dispenser connector for interconnecting a product dispenser to a mounting member.

BACKGROUND OF THE INVENTION

Product dispensers are used for a variety of purposes and for a variety of applications. It is commonly desired to have a product dispenser secured to a mounting member and readily available.

The present invention addresses the problems associated with the prior art devices and provides for a product dispenser connector configured and arranged to be secured to a variety of mounting members.

SUMMARY OF THE INVENTION

One aspect of the present invention provides a product dispenser assembly including a product dispenser, a mounting member, and a connector. The connector includes a first portion and a second portion. The first portion includes a receiving member configured and arranged to operatively connect the product dispenser thereto. The second portion includes a connecting member configured and arranged to operatively connect the mounting member thereto. The first and second portions are rotatably operatively connected to position the receiving member and the connecting member in different positions relative to one another.

Another aspect of the present invention provides a product dispenser connector including a front portion, a rear portion, and a connector. The front portion includes a receiving member configured and arranged to releasably connect a product dispenser thereto. The rear portion includes a connecting member and an adjusting member. The connecting member is configured and arranged to releasably connect the rear portion to a mounting member. The adjusting member has an engaging portion. The connector portion interconnects the front portion and the rear portion. The rear portion is rotatably operatively connected to the front portion and the connector portion. The connector portion includes a first notch and a second notch. The engaging portion engages the first notch in a first configuration and engages the second notch in a second configuration.

Another aspect of the present invention provides a product dispenser connector including a first portion, a second portion, and a locking member. The first portion includes a receiving member configured and arranged to operatively connect a product dispenser thereto. The second portion includes a connecting member configured and arranged to operatively connect a mounting member thereto. The second portion is rotatably operatively connected to the first portion. The locking member selectively releasably locks the first portion and the second portion together in at least two configurations.

Another aspect of the present invention provides a method of connecting a product dispenser to a mounting member with a connector. The connector comprises a first portion, a second portion, and a locking member. The first portion includes a receiving member configured and arranged to operatively connect the product dispenser thereto. The second portion includes a connecting member configured and arranged to operatively connect the mounting member thereto. The first and second portions are rotatably operatively connected and the locking member selectively releasably locks the first portion and the second portion together in at least two configurations. The mounting member, which has a first orientation, is located and the desired first configuration of the connector is determined. The first and second portions are positioned into the desired first configuration of the connector. The connecting member is connected to the mounting member, and the product dispenser is connected to the receiving member.

DETAILED DESCRIPTION OF A PREFERRED EMBODIMENT

Figure 2:
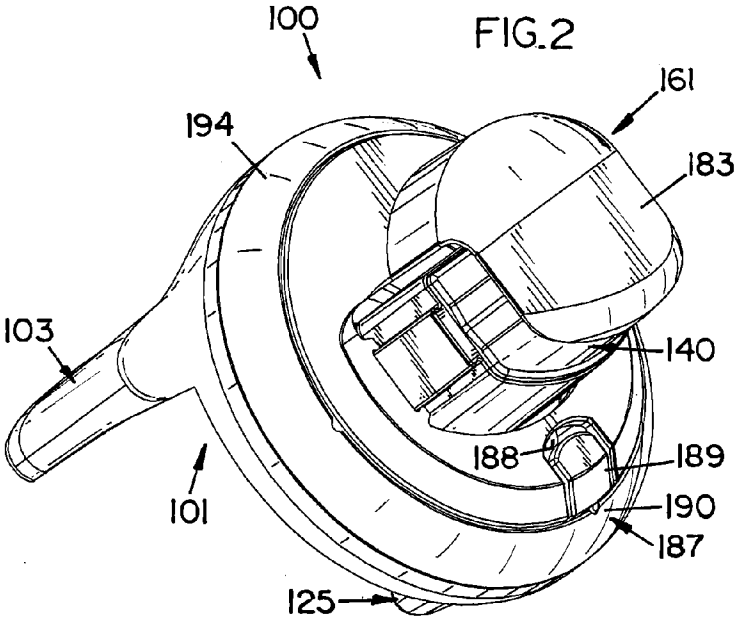
FIG. 2 is a rear perspective view of the product dispenser connector shown in FIG. 1.

Examples of preferred embodiment product dispenser connectors constructed according to the principles of the present invention are designated by the numerals 100, 300, 500, 600, 700, 800, 900, 1000, and 1100 in the drawings.

The product dispenser connector 100 includes a first base portion 101 operatively connected to a second base portion 161 with a connecting portion 194. Relative to how the product dispenser connector 100 is preferably positioned during use, the first base portion 101 is proximate the front, the second base portion 161 is proximate the rear, and the connecting portion 194 is proximate the middle of the product dispenser connector 100. The second base portion 161 is preferably rotatable relative to the first base portion 101.

Figure 1:
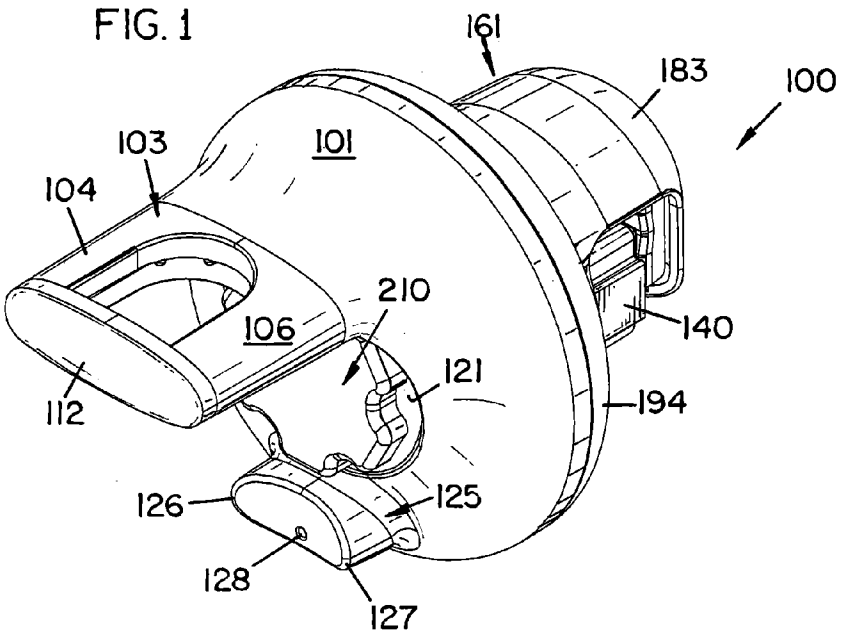
FIG. 1 is a front perspective view of a product dispenser connector constructed according to the principles of the present invention.
Figure 3:
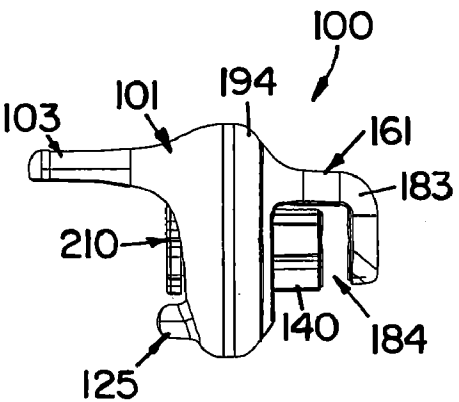
FIG. 3 is a side view of the product dispenser connector shown in FIG. 1.
Figure 5:
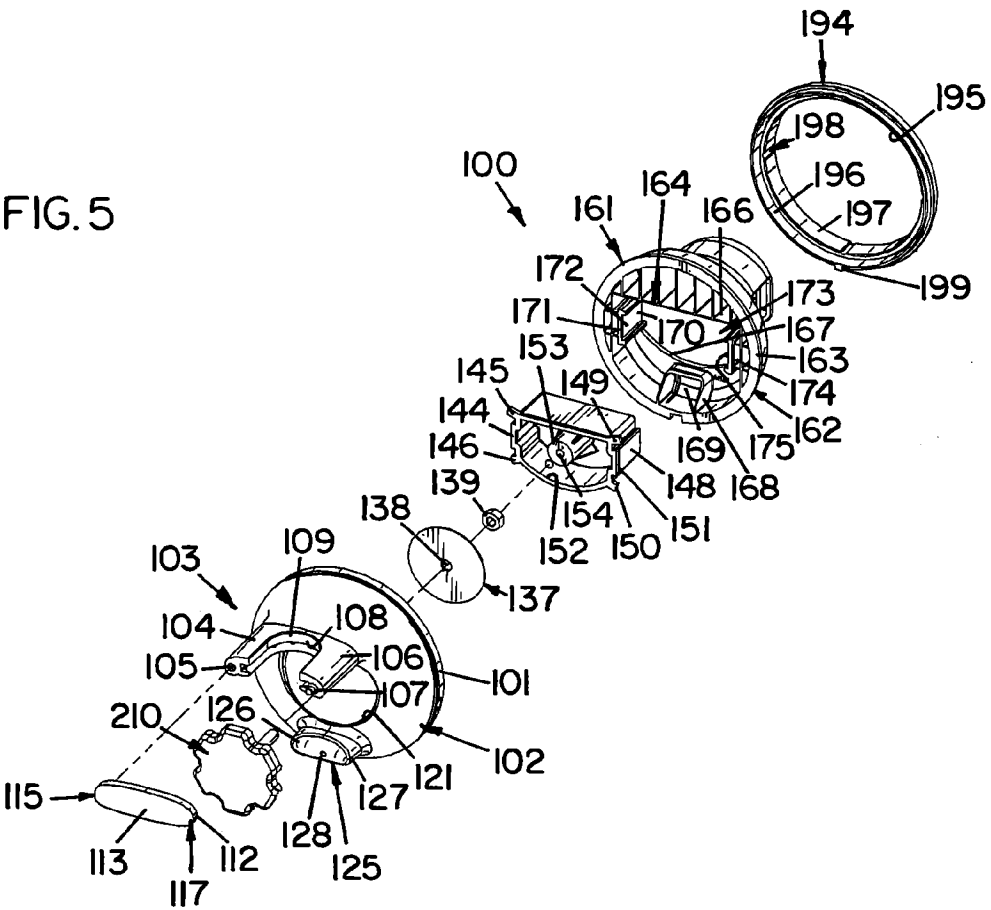
FIG. 5 is a front exploded perspective view of the product dispenser connector shown in FIG. 1.

The first base portion 101 includes a front 102, from which a top extension portion 103 and a bottom extension portion 125 extend outward, and a rear 131. The extension portions 103 and 125 are preferably integrally molded with the first base portion 101, but it is recognized the extension portions 103 and 125 could be operatively connected to the front 102 by other suitable means well known in the art. The extension portions 103 and 125 are shown in FIGS. 1 and 5.

The top extension portion 103 includes a first arm 104 extending outward proximate one side and a second arm 106 extending outward proximate an opposing side of the front 102. The arms 104 and 106 define a U-shaped extension portion with a notch 108 with a groove 109 extending from the front end of the first arm 104, through the front 102 between the arms 104 and 106, and to the front end of the second arm 106. The first arm 104 includes a bore 105 proximate its front end extending longitudinally through at least a portion of the first arm 104. The second arm 106 includes a protrusion 107 extending outward from its front end.

An interconnecting portion 112, which is a type of connector, interconnects the arms 104 and 106 proximate the front ends. The interconnecting portion 112 includes a front 113, a rear 114, a first end 115, and a second end 117. A protrusion 116 extends outward from the rear 114 proximate the first end 115, and a receptacle 118 is formed in the rear 114 proximate the second end 117. The protrusion 116 is configured and arranged to mate with the bore 105 of the first arm 104, and the receptacle 118 is configured and arranged to mate with the protrusion 107 of the second arm 106. Preferably, the bore 105 is smaller proximate its opening and the protrusion 116 is larger proximate its end so that the protrusion 116 snap fits within the bore 105 and the interconnecting portion 112 is pivotable about the protrusion 116 within the bore 105. Preferably, the receptacle 118 is a notch with an opening proximate the bottom of the interconnecting portion 112, and the opening is smaller than the cavity of the notch so that the protrusion 107 snap fits into the receptacle 118. Thus, the second end 117 of the interconnecting portion 112 is releasably connectable to the second arm 106 and the interconnecting portion 112 is pivotable to open and close access to the notch 108.

The front 102 also includes a recessed portion 121 between the extension portions 103 and 125. The recessed portion 121 is preferably cylindrical and includes a bore 122 extending longitudinally through the first base portion 101 proximate the middle of the recessed portion 121.

The bottom extension portion 125 extends outward from the bottom of the front 102 and includes a front surface that is concave, curving inward proximate its middle, from a first side 126 to a second side 127. An aperture 128 may be included as a drain hole through which any water entering the cavity of the device may drain.

Figure 6:
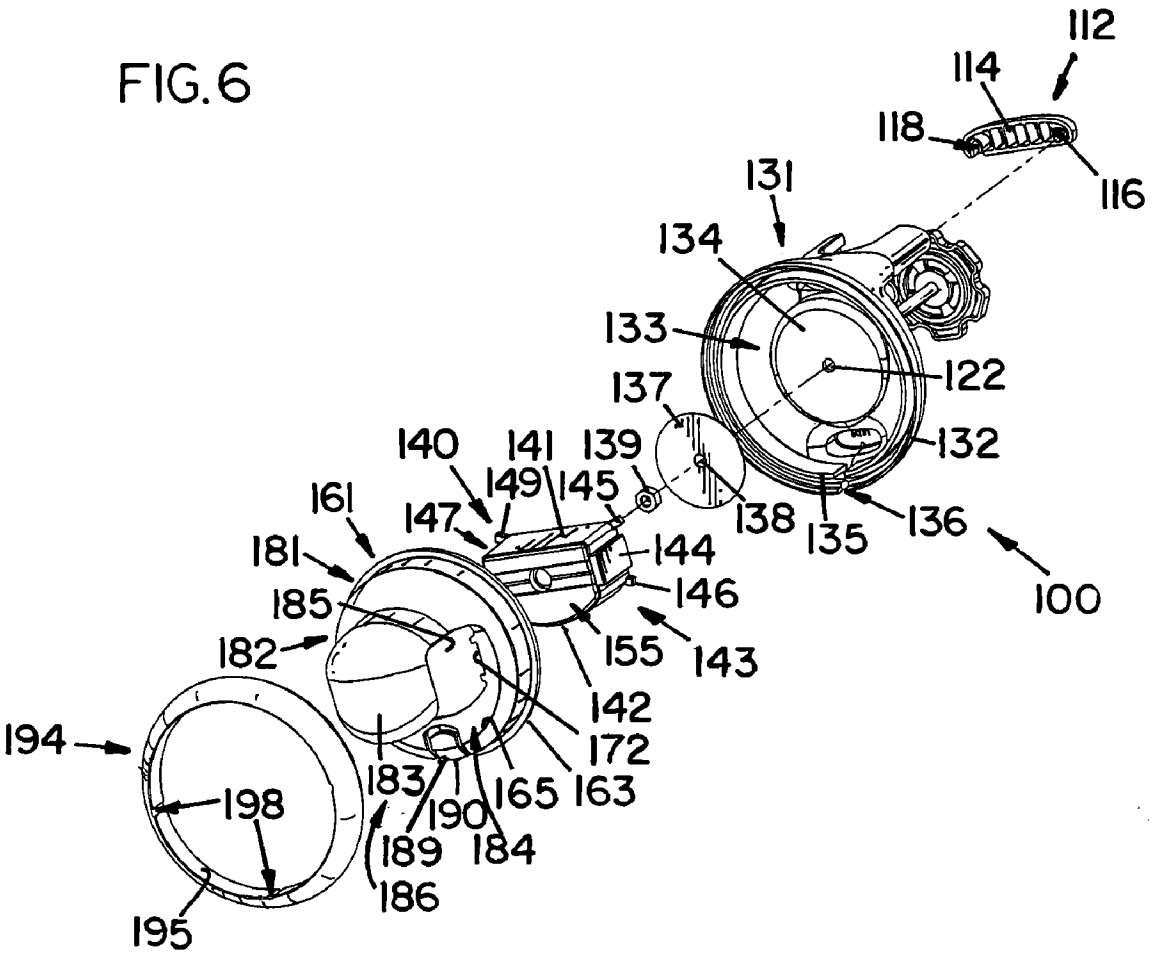
FIG. 6 is a rear exploded perspective view of the product dispenser connector shown in FIG. 1.

As shown in FIG. 6, the rear 131 of the first base portion 101 preferably includes sides extending outward from the front 102 to define a cavity 133. The front 102 and the rear 131 are preferably molded as an integral piece, but it is recognized that they could be operatively connected by other suitable means well known in the art. A flange 132 extends laterally outward from the rear 131, and the flange 132 is preferably cylindrical in shape. The flange 132 includes a notch 136 proximate the bottom of the first base portion 101. Proximate the juncture of the rear 131 and the flange 132 within the cavity 133 is a surface 135, which a ring-like ledge around the perimeter of the cavity 133. A plate member 134, which is the rear side of the recessed portion 121, is proximate the middle of the cavity 133, and the bore 122 extends through the plate member 134. A plate member 137, which is preferably disk-shaped, includes an aperture 138 and is positioned proximate the plate member 134. The aperture 138 aligns with the bore 122. A nut 139 is positioned proximate the plate member 137 with its aperture in alignment with the aperture 138.

The second base portion 161 includes a front 162 and a rear 181 and defines a cavity 164 accessible through an opening in the front 162. A flange 163 extends laterally outward from the front 162 and is preferably cylindrical in shape. The rear 181 includes an aperture 165 with a top 166, a bottom 167, a first side 170, and a second side 173. Proximate the first side 170 is a first receiver 171 defining a first channel 172, and proximate the second side 173 is a second receiver 174 defining a second channel 175. Proximate between the bottom 167 and the bottom side of the second base portion 161 is an upside down U-shaped flange 168 defining a cavity 169.

The rear 181 includes a top 182, from which an L-shaped extension portion 183 extends outward and then downward, and a bottom 186. The L-shaped extension portion 183 and the rear 181 define an opening 184 providing access to a cavity 185 therebetween. The L-shaped extension portion 183 is shown in FIGS. 2 and 6. The downward extending portion of the L-shaped extension portion 183 includes a friction member 191 operatively connected to its inner surface. The friction member 191 is preferably a thin, non-slip material. The bottom 186 includes a cut-out portion 187 defining a space 188 around a button 189, and the space 188 is a void of material corresponding with the inside perimeter of the flange 168. The cut-out portion 187 does not extend across the bottom of the button 189, and a tab 190 extends downward from the bottom of the button 189.

The connecting portion 194, which interconnects the first base portion 101 and the second base portion 161, is a ring-like portion including a bore 195. The inner surface of the connecting portion 194 proximate the bore 195 includes a first surface 196 and a second surface 197. As shown in FIG. 5, the first surface 196 is more proximate the front and is like a longitudinally extending flange. The second surface 197 is more proximate the rear and has a smaller diameter than the first surface 196. The second surface 197 includes a plurality of notches 198, preferably at least two, and more preferably at least three approximately ninety degrees from one another proximate the sides and the bottom. A protrusion 199 extends downward from the bottom of the connecting portion 194 proximate the front.

A connector 140 is configured and arranged to slidably fit within the aperture 165 of the second base portion 161 and includes a top 141 corresponding with the top 166, a bottom 142 corresponding with the bottom 167, a first side 143 corresponding with the first side 170, and a second side 147 corresponding with the second side 173. The first side 143 includes a first rail member 144 configured and arranged to slide within the first channel 172, and the second side 147 includes a second rail member 148 configured and arranged to slide within the second channel 175. The first side 143 also includes a top tab 145 extending outward proximate the juncture of the first side 143 and the top 141 and a bottom tab 146 extending outward proximate the juncture of the first side 143 and the bottom 142. The second side 147 also includes a top tab 149 extending outward proximate the juncture of the second side 147 and the top 141 and a bottom tab 150 extending outward proximate the juncture of the second side 147 and the bottom 142.

The front 151 of the connector 140 includes an opening providing access to a cavity 152. The rear 155 is a plate-like portion from which sides extend outward toward the front 151. A cylindrical boss 153 with a bore 154 extends longitudinally outward from the rear 155 toward the front 151 within the cavity 152. A friction member 156 is operatively connected to the rear 155. The friction member 156 is preferably a thin, non-slip material. The connector 140 is an opposing member to the downward extending portion of the L-shaped extension portion 183.

Figure 8:
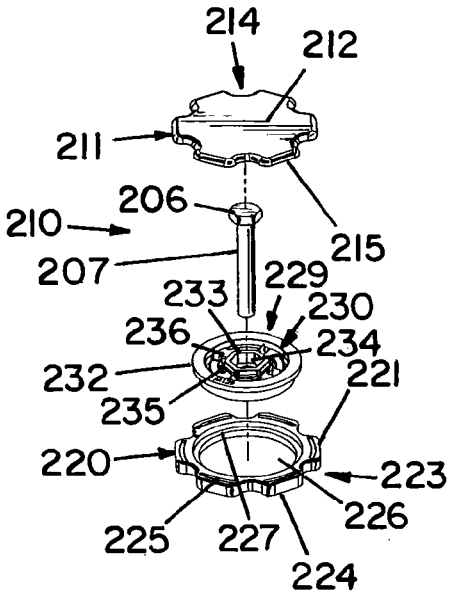
FIG. 8 is an exploded perspective view of the knob shown in FIG. 7.
Figure 7:
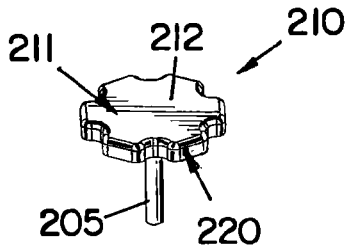
FIG. 7 is a perspective view of a knob of the product dispenser connector shown in FIG. 1.
Figure 9:
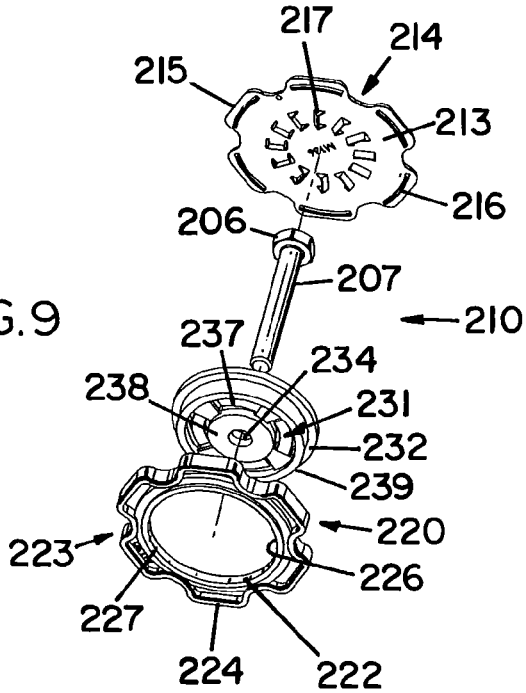
FIG. 9 is a rear exploded perspective view of the knob shown in FIG. 7.
Figure 10:
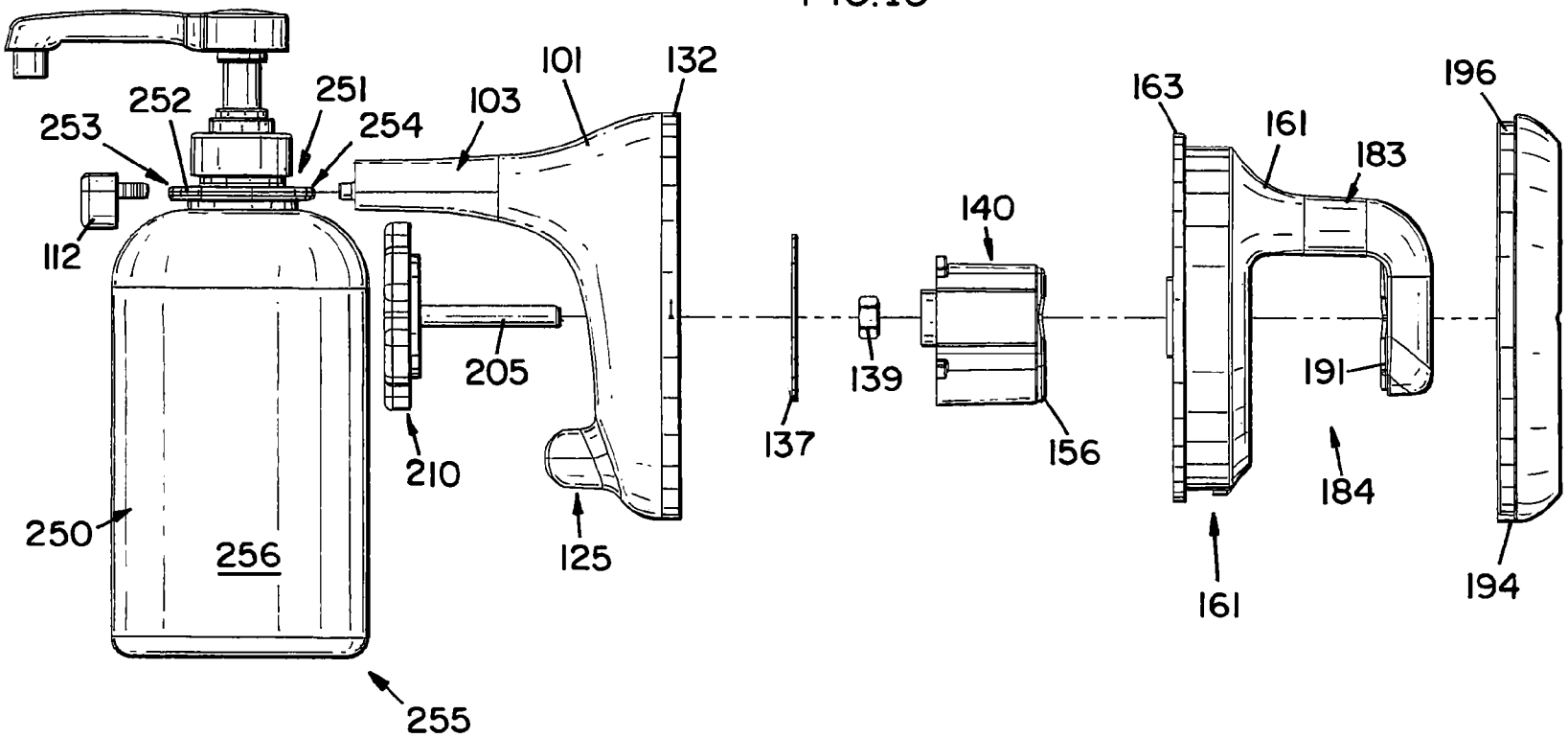
FIG. 10 is a side view of the product dispenser connector shown in FIG. 1 with a product dispenser.

A knob 210, shown in FIGS. 7-9, includes an intermediate portion 229 positioned between a first portion 211 and a second portion 220, to which a bolt 205 including a head 206 and a shaft 207 is connected. The first portion 211 is generally a round, disk-like member with a plurality of alternating notches 214 and protrusions 215, preferably six of each, spaced about its perimeter. The front 212 is preferably smooth, and the rear 213 includes a male portion 216 proximate each protrusion 215 and a plurality of ratchet teeth 217 forming a circle proximate the middle of the first portion 211.

The second portion 220 is similarly shaped as the first portion 211 but includes an opening 226 so the second portion 220 is a ring-like member. The second portion 220 includes a plurality of alternating notches 223 and protrusions 224 corresponding with the notches 214 and protrusions 215 of the first portion 211. The front 221 of the second portion 220 includes a female portion 225 proximate each protrusion 224 configured and arranged to receive each corresponding male portion 216 of the first portion 211, and the first portion 211 and the second portion 220 are preferably glued or welded together. A surface 227 extends inward proximate the perimeter of the opening 226 and the rear 222.

The intermediate portion 229 has a cylindrical base portion 239 from which a flange 232 extends laterally outward proximate the front 230. A receptacle 233, which is preferably hex-shaped proximate the front 230, includes a bore 234 extending from the front 230 to the rear 231. A recessed portion 235 includes a plurality of openings 237 and protrusions 236 in a circular arrangement around the receptacle 233. A protrusion 236 extends upward proximate one side of each opening 237.

To assemble the knob 210, the head 206 of the bolt 205, which is preferably also hex-shaped, fits within the receptacle 233 of the intermediate portion 229, and the shaft 207 extends through the bore 234. The base 239 of the intermediate portion 229 is positioned within the opening 226 of the second portion 220, and the flange 232 sits on the surface 227. The first portion 211 is aligned with the second portion 220, and the male portions 216 fit into the corresponding female portions 225. The head 206 is positioned between the first portion 211 and the surface 238 of the intermediate portion 229, and the ratchet teeth 217 align with the protrusions 236. The first portion 211 and the second portion 220 are preferably glued or welded together.

To assemble the body of the product dispenser connector 100, the plate member 137 is positioned proximate the plate member 134 so that the aperture 138 aligns with the bore 122. The nut 139 is positioned proximate the plate member 137 so that the aperture of the nut 139 aligns with the aperture 138. The handle of the knob 210, formed by the first, second, and intermediate portions, is positioned within the recessed portion 121 and the shaft 207 of the bolt 205, which is threaded, extends through the bore 122 and the nut 139. The nut 139 is preferably glued or otherwise secured to the shaft 207 so that the shaft 207 cannot be pulled out of the first base portion 101. The distal end of the shaft 207 threadably mates with the connector 140 by being threaded into the bore 154.

Figure 4:
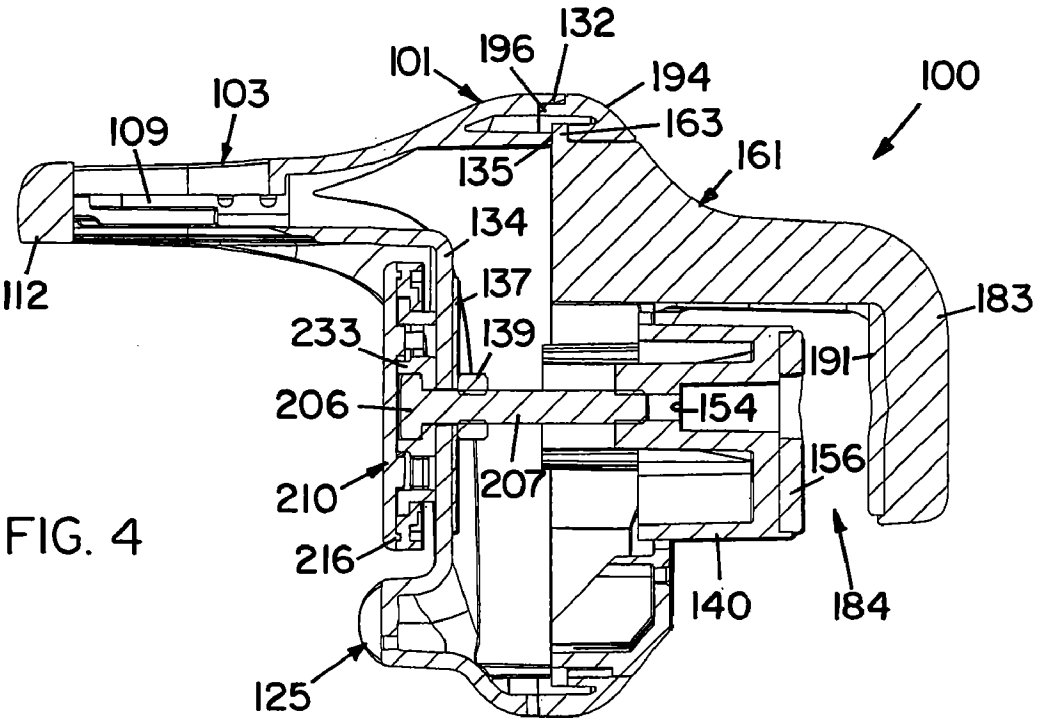
FIG. 4 is a side cross-section view of the product dispenser connector shown in FIG. 3.

The connector 140 is positioned within the aperture 165 of the second base portion 161 so that the rail members 144 and 148 slidably fit within the channels 172 and 175. The tabs 145, 146, 149, and 150 prevent the connector 140 from sliding completely out of the second base portion 161. The flange 163 of the second base portion 161 is positioned proximate the surface 135 of the first base portion 101, and the connecting portion 194 is slid over the second base portion 161 so that the first surface 196 of the connecting portion 194 fits concentrically proximate the flange 132 of the first base portion 101 and the second surface 197 is proximate the flange 163 of the second base portion 161. This is shown in FIG. 4. The connector 140 is preferably glued or otherwise secured to the first base portion 101. The protrusion 199 of the connecting portion 194 fits within the notch 136 of the first base portion 101.

The tab 190 of the button 189 fits within one of the notches 198 of the connecting portion 194, and the button 189 may be pressed inward proximate the cavity 169, deflecting the tab 190 outward to disengage the notch 198, and the second base portion 161 may then be rotated relative to the first base portion 101 and the connecting portion 194 and positioned in any one of the other notches 198. The button 189 is biased so that when it is released it moves back into the engaging position within one of the notches 198 to be a locking member. The button 189 is also an adjusting member because it allows the tab 190, which is an engaging member, to engage and disengage one of the notches 198 and allows the connector 100 to be positioned in at least two configurations to accommodate different surfaces of the mounting member. One configuration allows for connecting the product dispenser connector 100 to a horizontally oriented mounting surface and a second configuration allows for connecting the product dispenser connector 100 to a vertically oriented mounting surface.

A product dispenser 250 is preferably bottle-shaped with a neck portion 251 connected to a base portion 256 with a bottom 255. The neck portion 251 includes a flange 252 extending outward therefrom. The front 253 of the flange 252 is preferably relatively flat, without a radiused edge, and the rear 254 is preferably rounded, with a radiused edge. The product dispenser 250 could contain sanitizer, lotion, soap, or any other suitable product. An example of a suitable product dispenser is the ENDURE™ 320 Advanced Care product dispenser by Ecolab Inc.

The flange 252 of the product dispenser 250 is positioned within the groove 109, and the interconnecting portion 112 is connected to the top extension portion 103. The top extension portion 103 receives the flange 252, and the interconnecting portion prevents the flange from sliding out of the top extension portion 103 when connected. As previously described, the protrusion 116 and the receptacle 118 of the interconnecting portion 112 are configured and arranged to mate with the bore 105 of the first arm 104 and the protrusion 107 of the second arm 106, respectively, to releasably connect the second end 117 of the interconnecting portion 112 to the second arm 106 so that the interconnecting portion 112 is pivotable to open and close access to the notch 108. Thus, when substantially all the product has been dispensed from the product dispenser, or when it is desired to change products and product dispensers, the second end 117 of the interconnecting portion 112 may be disconnected from the second arm 106 to pivot the interconnecting portion 112 preferably upward to allow the product dispenser to be slid out of the notch 108 through the opening between the arms 104 and 106.

To connect the product dispenser connector 100 to a mounting member, such as but not limited to intravenous poles, bed rails, and utility carts, it should first be determined which configuration is desired and the second base portion 161 should be rotated to the desired position. The second base portion 161 could be rotated to the desired position either prior to or after connecting the product dispenser connector 100 to the mounting member. The connector 140 and the downward extending portion of the L-shaped extension portion 183 form a connecting member. The surface of the mounting member is positioned within the opening 184 between the connector 140 and the L-shaped extension portion 183, and the handle of the knob 210 is rotated so that the connector 140 moves inward, closer to the L-shaped extension portion 183. As the knob 210 is rotated, the connector 140 moves along the shaft 207. The bolt 205 does not move inward or outward relative to the housing. The connector 140 preferably allows the size of the opening 184 to be adjusted from ¾ inch to 1½ inches. The friction members 156 and 191 are preferably at least partially pliable and made of a non-slip, rubber-like material to prevent the product dispenser connector 100 from sliding along the mounting member.

When the connector 140, which is an adjusting portion, and the downward extending portion of the L-shaped extension portion 183, which is a connecting portion, are sufficiently tightened and a predetermined increased amount of force is required to further tighten the device, the ratchet teeth 217 contact the protrusions 236, cause the protrusions to deflect 236, and make a clicking sound to indicate the device is sufficiently is tight. The first and second portions 211 and 220 rotate relative to the intermediate portion 229 so the bolt 205 does not rotate. This prevents the device from becoming over-tightened.

The product dispenser connector 100 may be re-used in different configurations to accommodate mounting members with different orientations.

Figure 11:
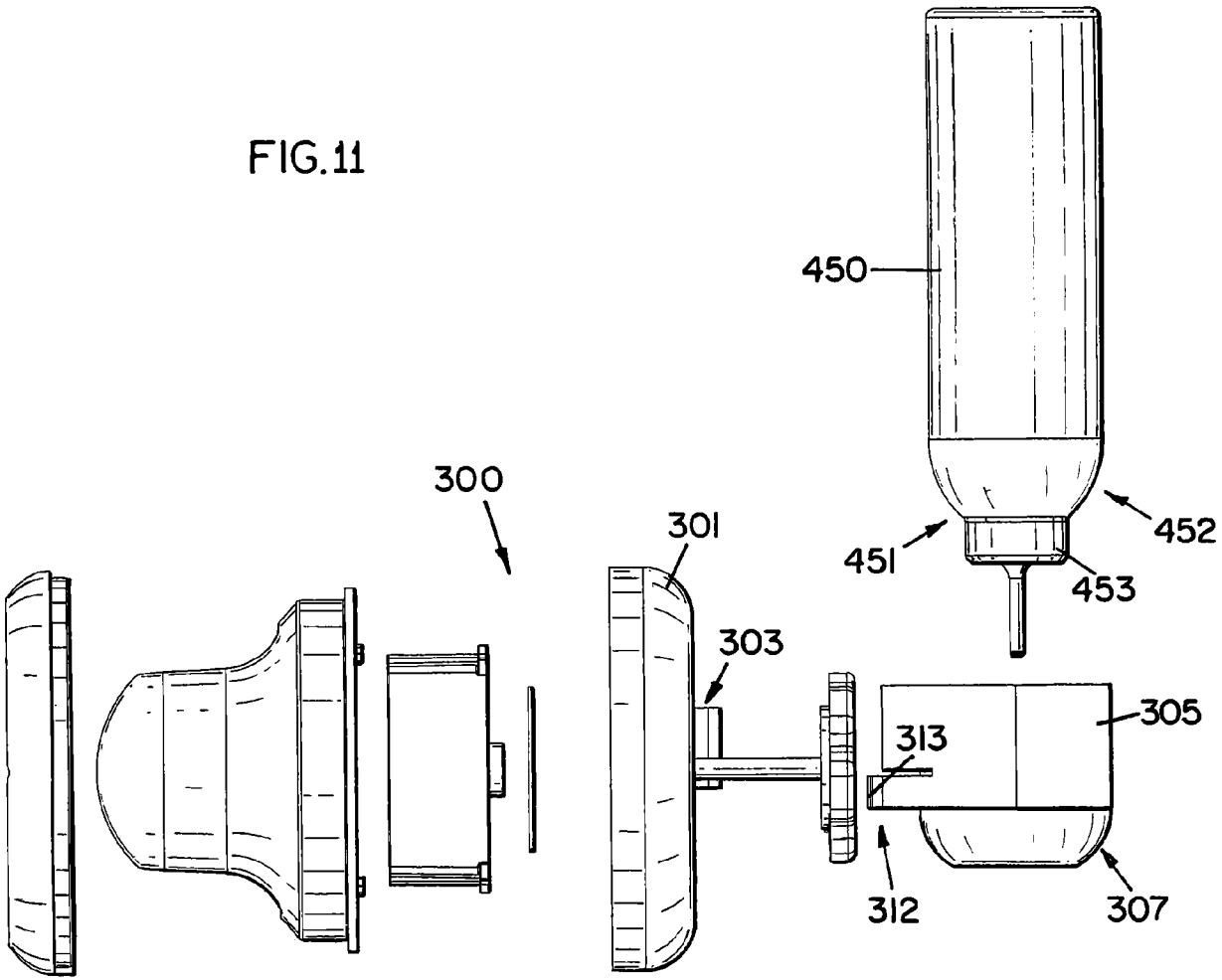
FIG. 11 is a side view of another embodiment product dispenser connector constructed according to the principles of the present invention with another product dispenser.
Figure 12:
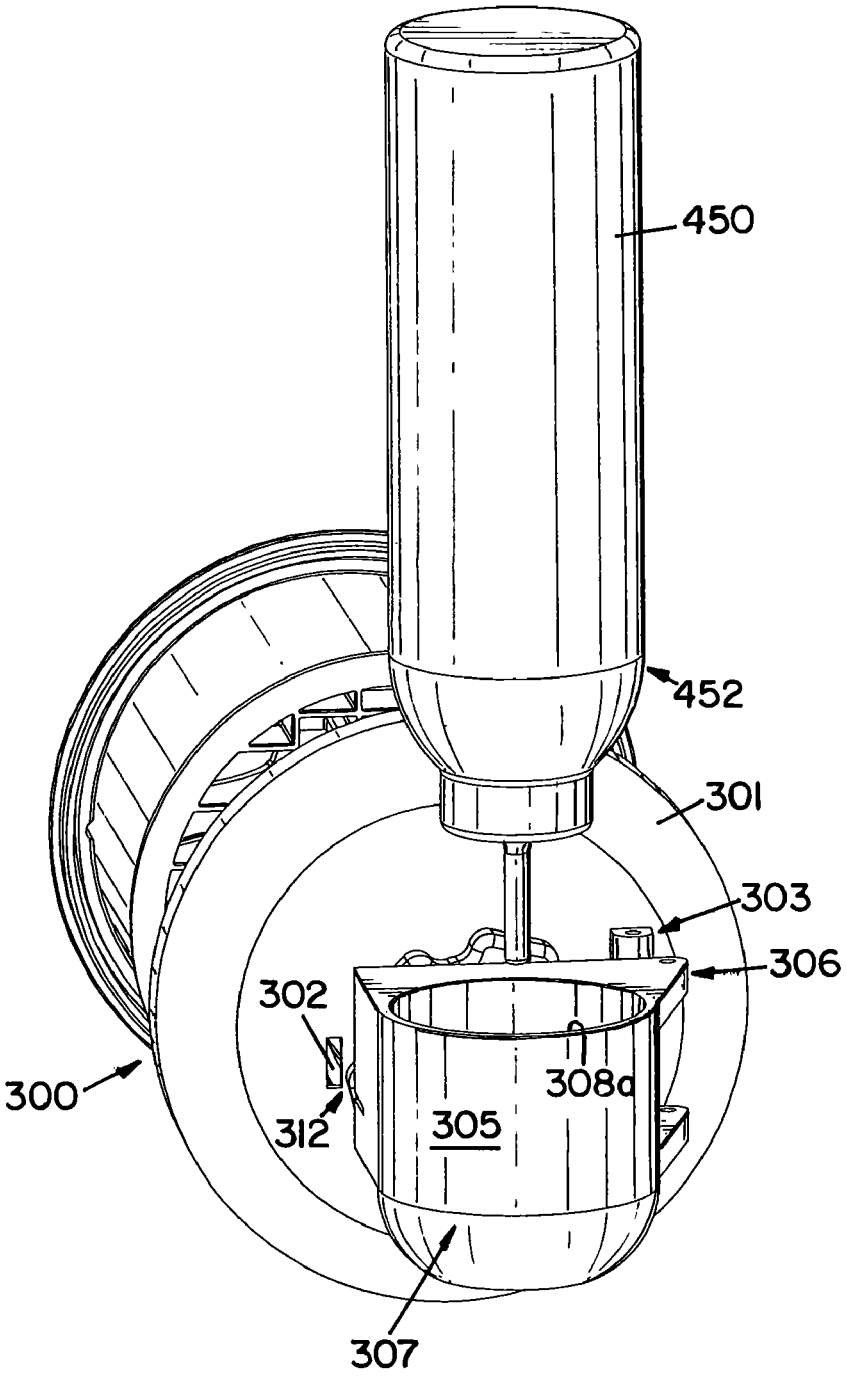
FIG. 12 is a front perspective view of the product dispenser connector shown in FIG. 11.
Figure 13:
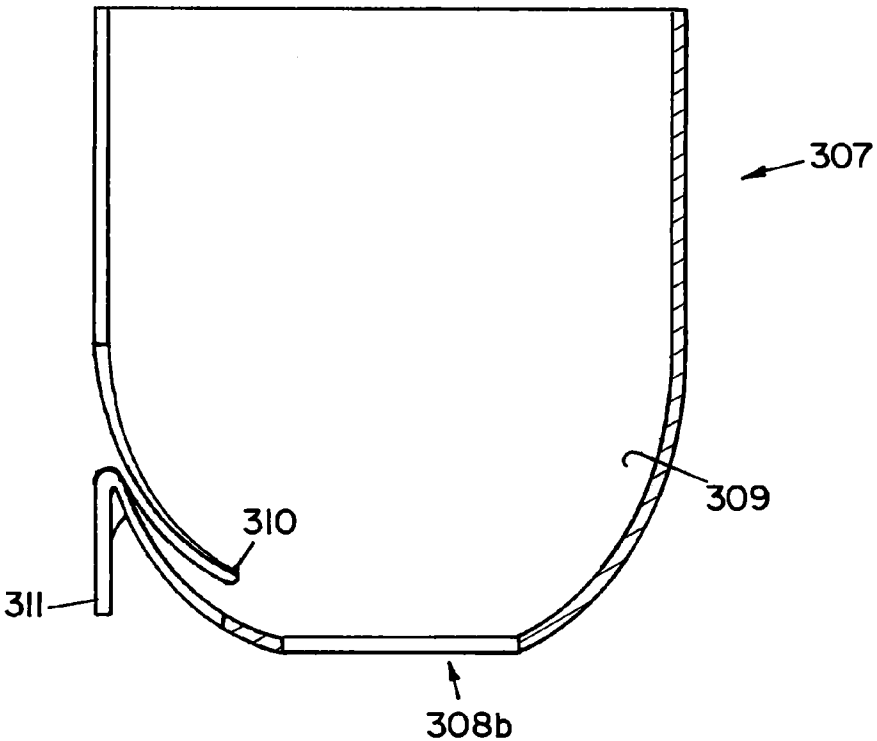
FIG. 13 is a cross section view of a cylindrical portion of the product dispenser connector shown in FIG. 11.

Another example of a product dispenser connector constructed according to the principles of the present invention is the product dispenser connector 300 shown in FIGS. 11 and 12. The product dispenser connector 300 is preferably similarly constructed as the product dispenser connector 100 so only the substantially different components will be described. The product dispenser connector 300 includes a first base portion 301 configured and arranged to releasably secure a different type of product dispenser 450 thereto. The first base portion 301 includes an aperture 302 and an extension portion 303 extending outward from the front of the first base portion 301. Preferably, the aperture is located proximate one side of the knob and the extension portion 303 is locate proximate an opposing side of the knob.

The extension portion 303 is configured and arranged to operatively connect to a protrusion 306 of a holder 305, which is configured and arranged to hold the product dispenser 450. The extension portion 303 is preferably a first hinge member, and the protrusion 306 is preferably a second hinge member. Preferably, the protrusion 306 (the second hinge member) includes a top protrusion and a bottom protrusion, and the extension portion 303 (the first hinge member) fits between the top and bottom protrusions. The first and second hinge members are preferably operatively connected with a pin member (not shown) so that the holder 305 may pivot about the pin member to allow access to the knob.

The holder 305 includes a cylindrical portion 307, which tapers inward proximate the bottom to correspond with the shape of the dispenser's shoulder portion 452, and includes a cavity 309 and an opening 308*a* in the top and an opening 308*b* in the bottom. Proximate the bottom, an engaging portion 310 extends inward and is operatively connected to a releasing portion 311 extending outward. The holder 305 preferably also includes a tab 312 corresponding with the aperture 302 of the first base portion 301. The tab 312 deflects inward as it is being inserted into the aperture 302 and then outward to engage the first base portion 301 with a protrusion 313. When engaged, the bottle holder 305 cannot be pivoted about the pin and the knob is positioned between the first base portion 301, the bottle holder 305, the hinges, and the tab 312. To disengage the tab 312, the tab 312 is deflected inward so that the protrusion 313 does not engage the first base portion 301 and pulled out of the aperture 302, and the bottle holder 305 may then be pivoted about the pin. This allows access to the knob.

When the dispenser 450 is positioned within the cavity 309, the shoulder portion 452 is positioned proximate the bottom, and the dispenser's outlet extends through the opening 308*b*. The engaging portion 310 fits between the gap 451 between the shoulder portion 452 and the neck portion 453. The engaging portion 310 prevents the dispenser from simply being lifted out of the cylindrical portion 307. To disengage the engaging portion 310, the releasing portion 311 is moved away from the cylindrical portion 307 to deflect the engaging portion 310 away from the dispenser.

Figure 15:
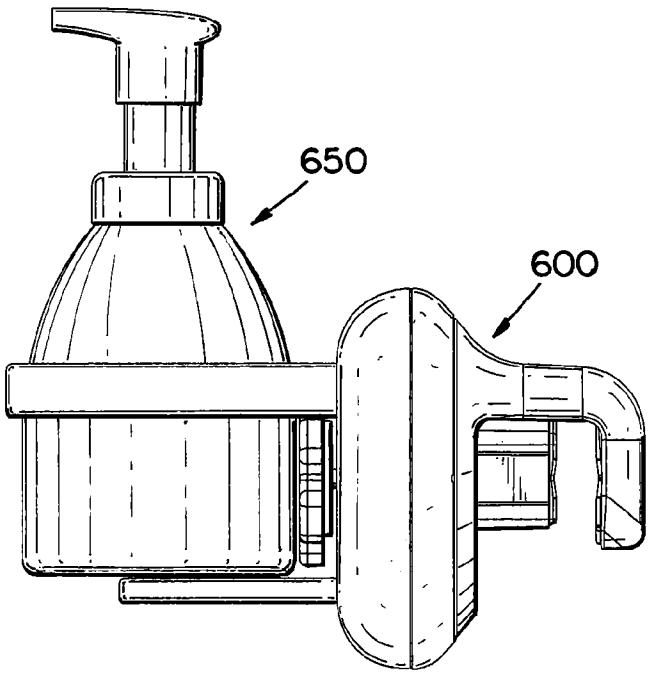
FIG. 15 is a side view of another embodiment product dispenser connector.
Figure 14:
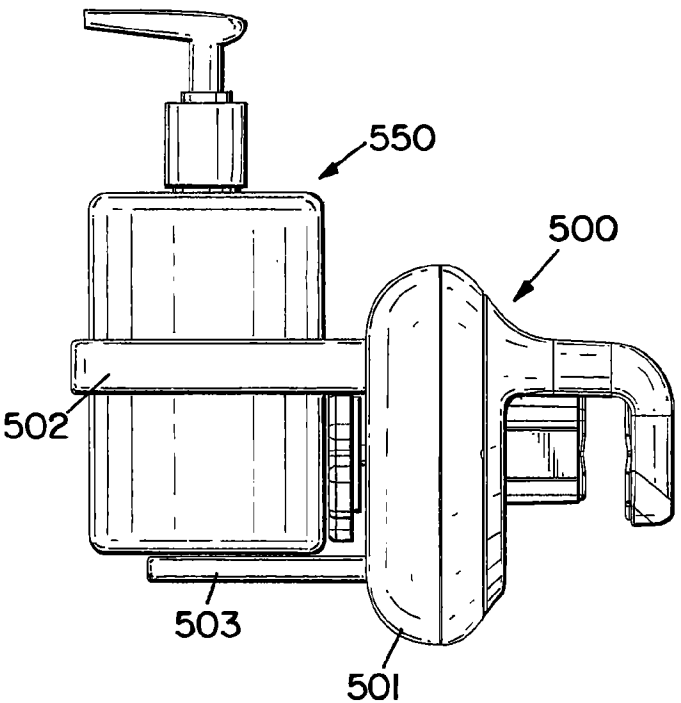
FIG. 14 is a side view of another embodiment product dispenser connector.
Figure 17:
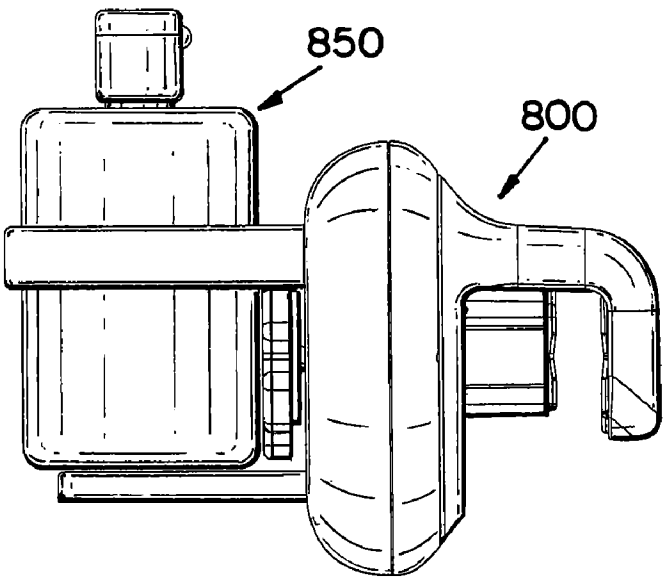
FIG. 17 is a side view of another embodiment product dispenser connector.
Figure 16:
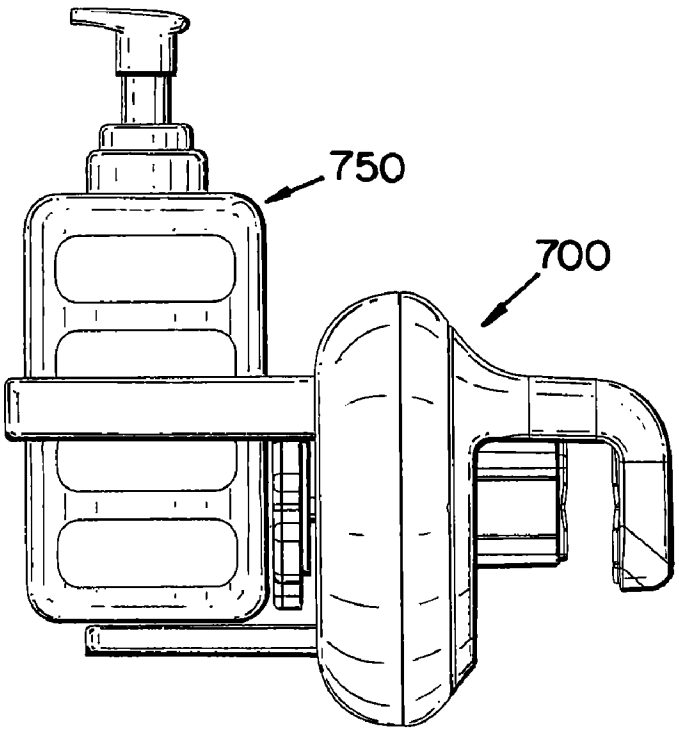
FIG. 16 is a side view of another embodiment product dispenser connector.

Another example of a product dispenser connector constructed according to the principles of the present invention is the product dispenser connector 500 shown in FIG. 14. The product dispenser connector 500 is preferably similarly constructed as the product dispenser connectors 100 and 300 so only the substantially different components will be described. The product dispenser connector 500 includes a first base portion 501 configured and arranged to hold a different type of product dispenser 550. The first base portion 501 includes a first extension portion 502 and a second extension portion 503. The first extension portion 502 includes a bore (not shown) through which the dispenser 550 is inserted, and the second extension portion 503 is a shelf-like member configured and arranged to support the bottom of the dispenser 550. As shown in FIGS. 15, 16, and 17, connectors 600, 700, and 800 are similarly configured and arranged to hold dispensers 650, 750, and 850, respectively.

Figure 18:
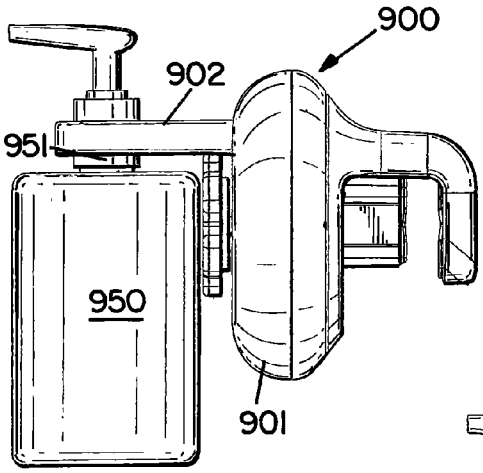
FIG. 18 is a side view of another embodiment product dispenser connector.
Figure 19:
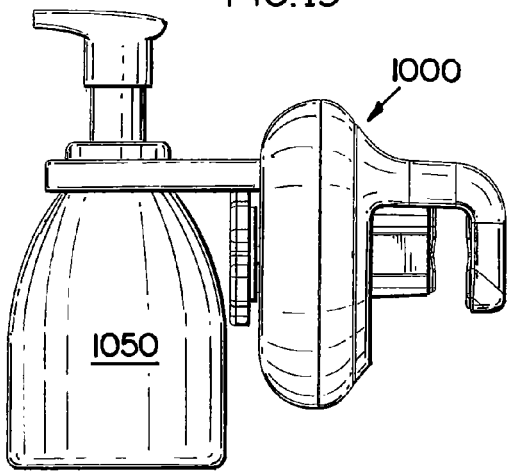
FIG. 19 is a side view of another embodiment product dispenser connector.
Figure 20:
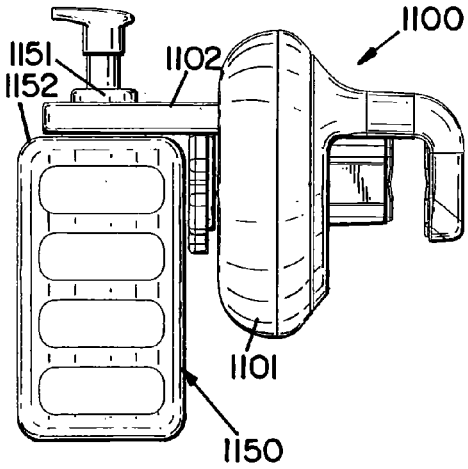
FIG. 20 is a side view of another embodiment product dispenser connector.

Other examples of product dispenser connectors constructed according to the principles of the present invention are the product dispenser connectors 900, 1000, and 1100 shown in FIGS. 18, 19, and 20 configured and arranged to support product dispensers 950, 1050, and 1150, respectively.

As shown in FIG. 18, the product dispenser connector 900 includes a first base portion 901 including an extension portion 902 configured and arranged to operatively connect to the neck 951 of the product dispenser 950. Although not shown, the neck 951 could include a recessed portion or a gap into which a flange of the extension portion 902 could be inserted to connect the product dispenser 950 thereto. Also, a suitable clamping or securing means could be used to connect the neck to the extension portion.

As shown in FIG. 20, the product dispenser connector 1100 includes a first base portion 1101 including an extension portion 1102 configured and arranged to operatively connect to the product dispenser 1150 proximate its neck 1151. The neck 1151 includes the connecting portion of the pump portion that threadably mates with threads on the bottle. There is a gap (not shown) between the shoulder 1152 and the neck 1151, and a two-prong fork-like member incorporated into the extension portion 1102 could fit within the gap on opposing sides of the product dispenser 1150. Further, an interconnecting portion, similar to the interconnecting portion 112, could be used to interconnect the two prongs. Alternatively, the extension portion 1102 could be larger than the bottle proximate the neck portion but smaller than the neck including the connecting portion of the pump portion so that the product dispenser is connected by disconnecting the pump portion from the bottle, sliding the bottle through the bore of the extension portion, and then connecting the pump portion to the bottle.

The product dispenser connector 1000 could be similarly configured and arranged as the product dispenser connectors 900 and 1100 to support the product dispenser 1050.

These examples are not intended to limit the scope of the invention as it is recognized that the connectors could be modified to accommodate many different types of product dispensers.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A product dispenser connector, comprising:

a front portion including a receiving member configured and arranged to releasably connect a product dispenser thereto;

a rear portion including a connecting member and an adjusting member, the connecting member being configured and arranged to releasably connect the rear portion to a mounting member, the adjusting member having an engaging portion, wherein the connecting member is an L-shaped extension portion extending outward proximate a first side of the rear portion and extending toward an opposing side of the rear portion, the connecting member and the rear portion defining an opening, wherein the connecting member further comprises an adjustable portion configured and arranged to vary a size of the opening, wherein the adjustable portion includes an opposing member operatively connected to a threaded rod portion threadably mating with the opposing member to move the opposing member rearward and frontward to vary the size of the opening, the mounting member being positioned between the L-shaped extension portion and the opposing member;

a connector portion interconnecting the front portion and the rear portion, the rear portion being rotatably operatively connected to the front portion and the connector portion, the connector portion including a first notch and a second notch, the engaging portion engaging the first notch in a first configuration and engaging the second notch in a second configuration; and a knob is operatively connected to the threaded rod portion, the front portion including a recessed portion, the knob being positioned within the recessed portion.

2. The product dispenser connector of claim 1, wherein the product dispenser includes a flange and the receiving member engages the flange.

3. The product dispenser connector of claim 2, wherein the receiving member includes a U-shaped extension portion having a first arm with a first end and a second arm with a second end and defining an opening, the flange being engaged by the first and second arms within the opening, and a connector being releasably operatively connected to the first end and the second end to releasably connect the product dispenser to the receiving member.

4. The product dispenser connector of claim 1, wherein the opposing member includes a non-slip surface.

5. The product dispenser connector of claim 1, wherein the adjusting member deflects to disengage the connector portion.

6. The product dispenser connector of claim 1, wherein the first configuration allows for connecting the product dispenser connector to a horizontally oriented mounting member and the second configuration allows for connecting the product dispenser connector to a vertically oriented mounting member.

7. The product dispenser connector of claim 1, wherein the mounting member is selected from the group consisting of intravenous poles, bed rails, and utility carts.

8. The product dispenser connector of claim 1, wherein the product dispenser dispenses a product selected from the group consisting of sanitizer, lotion, and soap.

9. The product dispenser connector of claim 1, wherein the receiving member includes a U-shaped extension portion having a first arm with a first end and a second arm with a second end and defining an opening, the first arm and the second arm extending outward from the front portion.

10. The product dispenser connector of claim 9, further comprising a receiving member connector being releasably operatively connected to the first end and the second end to releasably connect the product dispenser to the receiving member.

11. The product dispenser connector of claim 1, wherein the receiving member includes a cylindrical portion configured and arranged to support the product dispenser, the cylindrical portion being pivotable relative to the front portion.

12. The product dispenser connector of claim 1, wherein the receiving member includes a first extension portion with a bore and a second extension portion, the first extension portion configured and arranged to hold a middle portion of the product dispenser and the second extension portion supporting a bottom of the product dispenser.

13. The product dispenser connector of claim 1, wherein the receiving member is configured and arranged to connect to a neck portion of the product dispenser.

14. A product dispenser connector, comprising:

a front portion including a receiving member configured and arranged to releasably connect a product dispenser thereto;

a rear portion including a connecting member and an adjusting member, the connecting member being configured and arranged to releasably connect the rear portion to a mounting member, the adjusting member having an engaging portion, wherein the connecting member is an L-shaped extension portion extending outward proximate a first side of the rear portion and extending toward an opposing side of the rear portion, the connecting member and the rear portion defining an opening, wherein the connecting member further comprises an adjustable portion configured and arranged to vary a size of the opening, wherein the adjustable portion includes an opposing member operatively connected to a threaded rod portion threadably mating with the opposing member to move the opposing member rearward and frontward to vary the size of the opening, the mounting member being positioned between the L-shaped extension portion and the opposing member;

a connector portion interconnecting the front portion and the rear portion, the rear portion being rotatably operatively connected to the front portion and the connector portion, the connector portion including a first notch and a second notch, the engaging portion engaging the first notch in a first configuration and engaging the second notch in a second configuration; and a knob is operatively connected to the threaded rod portion, the knob ratcheting when a predetermined amount of force is required to further tighten the adjustable portion and the L-shaped extension portion against the mounting member to prevent over-tightening.

15. The product dispenser connector of claim 14, wherein the product dispenser includes a flange and the receiving member engages the flange.

16. The product dispenser connector of claim 14, wherein the receiving member includes a U-shaped extension portion having a first arm with a first end and a second arm with a second end and defining an opening, the flange being engaged by the first and second arms within the opening, and a connector being releasably operatively connected to the first end and the second end to releasably connect the product dispenser to the receiving member.

17. The product dispenser connector of claim 14, wherein the opposing member includes a non-slip surface.

18. The product dispenser connector of claim 14, wherein the adjusting member deflects to disengage the connector portion.

19. The product dispenser connector of claim 14, wherein the first configuration allows for connecting the product dispenser connector to a horizontally oriented mounting member and the second configuration allows for connecting the product dispenser connector to a vertically oriented mounting member.

20. The product dispenser connector of claim 14, wherein the mounting member is selected from the group consisting of intravenous poles, bed rails, and utility carts.

21. The product dispenser connector of claim 14, wherein the product dispenser dispenses a product selected from the group consisting of sanitizer, lotion, and soap.

22. The product dispenser connector of claim 14, wherein the receiving member includes a U-shaped extension portion having a first arm with a first end and a second arm with a second end and defining an opening, the first arm and the second arm extending outward from the front portion.

23. The product dispenser connector of claim 14, further comprising a receiving member connector being releasably operatively connected to the first end and the second end to releasably connect the product dispenser to the receiving member.

24. The product dispenser connector of claim 14, wherein the receiving member includes a cylindrical portion configured and arranged to support the product dispenser, the cylindrical portion being pivotable relative to the front portion.

25. The product dispenser connector of claim 14, wherein the receiving member includes a first extension portion with a bore and a second extension portion, the first extension portion configured and arranged to hold a middle portion of the product dispenser and the second extension portion supporting a bottom of the product dispenser.

26. The product dispenser connector of claim 14, wherein the receiving member is configured and arranged to connect to a neck portion of the product dispenser.

27. A product dispenser connector comprising:

a first portion including a receiving member configured and arranged to operatively connect a product dispenser thereto;

a second portion including a connecting member configured and arranged to operatively connect a mounting member thereto, the second portion being rotatably operatively connected to the first portion;

a locking member selectively releasably locking the first portion and the second portion together in at least two configurations, the locking member including at least two notches and the second portion including a tab extending outward therefrom, the tab being configured and arranged to engage a first of the at least two notches in a first configuration and to engage a second of the at least two notches in a second configuration; and a button operatively connected to the tab, wherein the button is pressed to deflect the tab and disengage the notch, wherein the connecting member and the second portion define an opening, the connecting member further comprises an adjustable portion configured and arranged to vary a size of the opening, the adjustable portion including an opposing member operatively connected to a threaded rod portion threadably mating with the opposing member to move the opposing member rearward and frontward to vary the size of the opening, the mounting member being positioned between the connecting member and the opposing member, and further comprising a knob operatively connected to the threaded rod portion, the knob ratcheting when a predetermined amount of force is required to further tighten the adjustable portion and the connecting member against the mounting member to prevent over-tightening.

28. The product dispenser connector of claim 27, wherein the receiving member includes a U-shaped extension portion having a first arm with a first end and a second arm with a second end and defining an opening, the product dispenser being engaged by the first and second arms within the opening, and a connector being releasably operatively connected to the first end and the second end to releasably connect the product dispenser to the receiving member.

29. The product dispenser connector of claim 27, wherein the receiving member includes a cylindrical portion configured and arranged to support the product dispenser, the cylindrical portion being pivotable relative to the first portion.

30. The product dispenser connector of claim 27, wherein the receiving member includes a first extension portion with a bore and a second extension portion, the first extension portion configured and arranged to hold a middle portion of the product dispenser and the second extension portion supporting a bottom of the product dispenser.

31. The product dispenser connector of claim 27, wherein the receiving member is configured and arranged to connect to a neck portion of the product dispenser.

32. The product dispenser connector of claim 27, wherein the connecting member and the second portion define an opening, the connecting member further comprises an adjustable portion configured and arranged to vary a size of the opening, the adjustable portion including an opposing member operatively connected to a threaded rod portion threadably mating with the opposing member to move the opposing member rearward and frontward to vary the size of the opening, the mounting member being positioned between the connecting member and the opposing member, and further comprising a knob operatively connected to the threaded rod portion, the first portion including a recessed portion configured and arranged to receive the knob.

* * * * *

UNITED STATES PATENT AND TRADEMARK OFFICE

CERTIFICATE OF CORRECTION

PATENT NO. : 8,286,835 B2
APPLICATION NO. : 12/125438
DATED : October 16, 2012
INVENTOR(S) : John D. Morey et al.

It is certified that error appears in the above-identified patent and that said Letters Patent is hereby corrected as shown below:

In the Claims

Claim 23, Column 11, Line 36:

"14" should read as -- 22 --

Signed and Sealed this
Third Day of November, 2015

Michelle K. Lee

Michelle K. Lee
*Director of the United States Patent and Trademark Office*